US005538693A

United States Patent [19]

Olivier et al.

[11] Patent Number: 5,538,693

[45] Date of Patent: Jul. 23, 1996

[54] VARYING SWITCHING TEMPERATURE SET-POINT METHOD FOR BED FLOW REVERSAL FOR REGENERATIVE INCINERATOR SYSTEMS

[75] Inventors: Stephen P. Olivier, Anaheim; Martin E. Tellkamp, La Habra Heights, both of Calif.

[73] Assignee: Tellkamp Systems, Inc., Santa Fe Springs, Calif.

[21] Appl. No.: 286,128

[22] Filed: Aug. 4, 1994

[51] Int. Cl.[6] ..... G05D 7/00; F01N 3/10; F23G 5/00

[52] U.S. Cl. ..... 422/111; 422/109; 422/173; 422/175; 422/206; 110/245; 110/345; 431/5; 431/120; 431/215

[58] Field of Search ..... 422/109, 111, 422/173, 175, 198, 206; 110/245, 210, 101 CA, 345; 431/5, 170, 120, 215; 165/4, 7, 10, 97, 104.13

[56] References Cited

U.S. PATENT DOCUMENTS

| | | | |
|---|---|---|---|
| 3,770,050 | 11/1973 | Nakanishi | 165/97 |
| 3,870,474 | 3/1975 | Houston | 23/277 |
| 4,444,735 | 4/1984 | Birmingham et al. | 423/210 |
| 4,741,690 | 5/1988 | Heed | 431/7 |
| 4,909,307 | 3/1990 | Besik | 165/4 |
| 5,024,817 | 6/1991 | Mattison | 422/111 |
| 5,186,901 | 2/1993 | Bayer et al. | 422/111 |
| 5,188,804 | 2/1993 | Pace et al. | 422/111 |
| 5,262,131 | 11/1993 | Bayer et al. | 422/175 |
| 5,346,259 | 11/1994 | Matros et al. | 431/5 |
| 5,417,927 | 5/1995 | Houston | 422/110 |
| 5,422,077 | 6/1995 | Bayer | 422/109 |
| B1 3,870,474 | 4/1991 | Houston | 422/171 |

*Primary Examiner*—Robert J. Warden
*Assistant Examiner*—Christopher Y. Kim
*Attorney, Agent, or Firm*—F. Eugene Logan

[57] ABSTRACT

A method for controlling gas flow direction through a regenerative incinerator system coupled to a flow reversing valve, and for reversing the flow direction of the gas stream through the regenerative incinerator system. The regenerative incinerator system having a combustion zone and one or more heat accumulating and heat exchanging zones. The method establishes a combustion zone base temperature set-point, or $T_{CB}$ for referencing combustion zone temperatures, or $T_C$'s, and an outlet base temperature set-point, or $T_{OB}$, for referencing outlet temperatures, or $T_O$'s, from the regenerative incinerator system. A switching temperature, or $T_S$, is also established as a function of $T_C$, $T_{CB}$ and $T_{OB}$ such that the slope of said function, i.e. $dT_S/dT_C$, is never negative over a predetermined range of combustion zone temperatures, or $T_C$'s. The switching temperature being equal to $T_{OB}$ when the combustion zone temperature is equal to $T_{CB}$. The flow direction is caused to reverse the flow direction of the gas stream through the regenerative incinerator system when the gas stream temperature from the regenerative incinerator system, or $T_O$, reaches $T_S$. In one embodiment, the slope of said function is zero when the combustion zone temperature is equal to $T_{CB}$.

24 Claims, 4 Drawing Sheets

VARYING SWITCHING TEMPERATURE SET-POINT METHOD FOR BED FLOW REVERSAL FOR REGENERATIVE INCINERATOR SYSTEMS

BACKGROUND OF THE INVENTION

Many large and small commercial industries produce waste gases or exhaust air that contain environmentally objectionable contaminants. Fumes such as solvents and other hydrocarbon substances, generally referred to as VOC, include gasoline vapors, paint fumes, chlorinated hydrocarbons. The most common method of eliminating such combustible fumes prior to emitting the exhaust gases to the atmosphere is incineration.

One method of incineration passes the waste gas or exhaust air stream through a fume incinerator prior to venting. U.S. Pat. No. 4,444,735 discloses a fume incinerator for incinerating combustible fumes in an oxygen bearing process exhaust stream. The process gas stream is passed through a flame front in the incinerator produced from burning fossil fuel, typically natural gas or fuel oil. In order to insure complete incineration of the combustible contaminants, the entire process exhaust stream must pass through the flame front. It is often necessary to preheat the process exhaust stream prior to contacting it with the flame front. The cost of the preheat heat exchanger and the auxiliary fuel make fume incinerators relatively expensive.

Multiple-bed, fossil fuel-fired regenerative incinerator, such as incinerators disclosed in U.S. Pat. Nos. 3,870,474 and 4,741,690 are also commonly used. Multiple-bed systems usually employ two or more regenerative beds of heat-accumulating and heat-transferring material disposed about a central combustion chamber equipped with a fossil fuel-fired burner. The process exhaust stream to be incinerated is passed through a first bed, then into a central combustion chamber for incineration in the flame produced by supplemental fuel and then discharged through a second bed. As the hotter incinerated process exhaust stream passes through the second bed, it loses heat to the bed material. After a period of time, the direction of gas flow through the system is reversed and the incoming process exhaust stream then passes first through the second bed, thereby preheating the incoming stream, then through the central combustion chamber, and then through the first bed. By periodically reversing the direction of gas flow, the incoming process exhaust stream is preheated by heat stored from the previously incineration cycle, thereby regenerating heat and reducing supplemental fuel requirements.

Usually regenerative thermal oxidizers control combustion zone temperature, or VOC destruction temperature, by adding supplementary fuel usually through a burner in the combustion zone or by adding fuel directly to the VOC process exhaust stream, when the VOC load decreases. If the VOC load increases and the combustion zone temperature rises above set-point, the supplementary fuel is closed off. If the combustion zone temperature continues to increase, makeup or purge air is added to cool the incinerator enough to prevent damage thereto. The purge air reduces process efficiency by increasing fan power cost. Switching flow directions entering and exiting the beds is usually performed on a fixed, timed sequence or schedule. In the past in such systems the temperature of the gas vented through the switching valve to the atmosphere after incineration has been maintained at a constant temperature, e.g. about 225° F. When the VOC loading drives the combustion temperature up, purge air has been added to lower the combustion temperature by allowing a larger quantity of hot vented gas to leave the oxidizer at about 225° F.

Another method of controlling vent gas temperature is disclosed in U.S. Pat. No. 5,186,901 in which exhaust gases are recirculated for cooling purposes. Recirculating exhaust gas or adding purge air reduces process efficiency by increasing fan power.

Examples of switching valves for regenerative incinerator systems are disclosed in U.S. Pat. Nos. 3,770,050, and 4,909,307.

SUMMARY OF INVENTION

Figure 1:
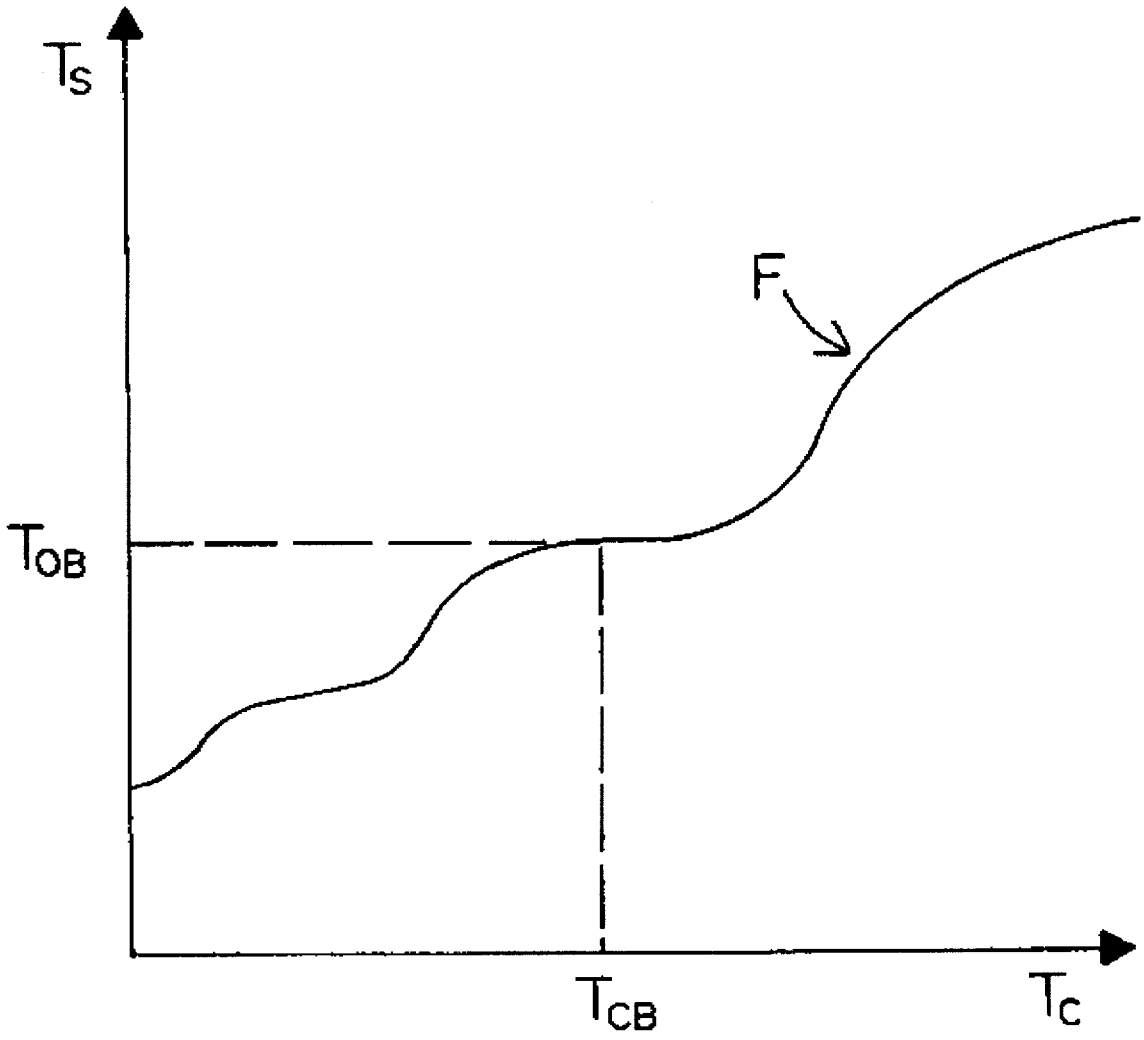
FIG. 1 is a graphic illustration of the switching temperature, or $T_S$, as function of $T_C$.

In the present invention switching flow directions into and out of the regenerative bed or beds occurs when the actual outlet temperature of the incinerated, cleaned gas vented to the atmosphere equals the switching temperature, or $T_S$. Switching temperature $T_S$ is varied upward or downward from the outlet base temperature set-point, or $T_{OB}$, as a function of the actual combustion zone temperature, or $T_C$. Varying switching temperature set-point maximizes thermal efficiency at low VOC loadings and eliminates the need for purge air and the associated fan power therefor at high VOC loadings.

When the VOC load decreases this invention lowers switching temperature $T_S$ which causes switching or reversing of flow direction into and out of the bed or beds to occur more frequently. This in turn lowers average outlet temperature and increases overall thermal energy efficiency. Once the switching is occurring as fast as practical and energy efficiency is at a maximum, supplementary fuel is used to trim the control of the combustion zone temperature.

When VOC load in the process exhaust stream increases this invention raises the switching temperature. This causes the switching or reversing of flow direction into or out of the bed or beds to occur less frequently. This in turn causes the average outlet temperature to increase as heat is "let out" or "wasted." However, less fan power is required than consumed by systems which add makeup or purge air. For a given design amount of VOC load existing systems must be larger than those of this invention, and as a consequence existing systems are more costly than this invention, which can operate over most varying VOC loads without the need for purge air.

Accordingly, there is provided by the principles of this invention a method for controlling a flow directing means used for directing a gas stream to and from a regenerative incinerator system and for reversing the flow direction of the gas stream through the regenerative incinerator system. In general, the regenerative incinerator system has a combustion zone and at least one heat accumulating and heat exchanging zone. The method comprises establishing a combustion zone base temperature set-point, or $T_{CB}$, for comparing combustion zone temperature, or $T_C$, to; and establishing an outlet base temperature set-point, or $T_{OB}$, for comparing outlet temperature, or $T_O$ to. The outlet temperature being the temperature of the gas stream from the regenerative incinerator system. The method also comprises establishing a switching temperature, or $T_S$, as a function of $T_C$, $T_{CB}$ and $T_{OB}$, wherein the slope of said function, i.e. $dT_S/dT_C$, is never negative over a predetermined range of combustion zone temperatures.

The method also causes the flow directing means to reverse the flow direction of the gas stream through the regenerative incinerator system when the gas stream temperature from the regenerative incinerator system, or $T_O$, reaches $T_S$.

In general, the switching temperature is set to equal the outlet base temperature set-point when the combustion zone temperature equals the combustion zone base temperature set-point, i.e. $T_S=T_{OB}$ when $T_C=T_{CB}$.

FIG. 1 illustrates the principles of this invention in which $T_{CB}$ and $T_{OB}$ are established and the switching temperature, or $T_S$, is shown to be a function of the combustion zone temperature, or $T_C$, as represented by curve "F". It is to be noted that the slope of curve F, i.e. $dT_S/dT_C$, is never negative although it can be zero at one or more combustion zone temperatures. In one embodiment, the slope of curve F is zero at a combustion zone temperature equal to the combustion zone base temperature set-point, i.e. $dT_S/dT_C=0$ at $T_C=T_{CB}$.

There is also provided by the principles of this invention a method for incinerating gas streams containing VOC comprising providing an incinerator means for incinerating a gas stream, the incinerator means having at least one gas permeable bed of solid material having heat-accumulating and heat-exchanging capability, and a combustion zone for combustion of the gas stream; and providing a flow directing means for directing the gas stream to and from the incinerator means and for reversing the flow direction of the gas stream to and from the incinerator means. The method also comprises introducing a gas stream containing VOC into the flow directing means; receiving the gas stream from the flow directing means and conveying it to a vent duct means; and discharging the gas stream from the vent duct means to an environment; sensing a combustion zone temperature, or $T_C$, in the combustion zone. The method further comprises establishing a combustion zone base temperature or $T_{CB}$; providing and controlling supplemental heating of the incinerator means so that such heating increases with increasing values of the temperature difference ($T_{CB}-T_C$), and is shut off when $T_C \geqq T_{CB}$; sensing an outlet temperature, or $T_O$, in the vent duct means; and establishing an outlet base temperature, or $T_{OB}$. The method still further comprises adjusting a switching temperature, or $T_S$, (i.) to $T_{OB}$, when ($T_{CB}-T_C$) is less than a first predetermined value and when ($T_C-T_{CB}$) is less than a second predetermined value, (ii.) downwards a first predetermined amount below $T_{OB}$, when ($T_{CB}-T_C$) is equal to or more than the first predetermined value, (iii.) upwards a second predetermined amount above $T_{OB}$, when ($T_C-T_{CB}$) is equal to or more than the second predetermined value; and causing the flow directing means to reverse the flow direction of the gas stream to and from the incinerator means when $T_O$ reaches $T_S$.

DESCRIPTION OF THE PREFERRED EMBODIMENTS

Figure 2:
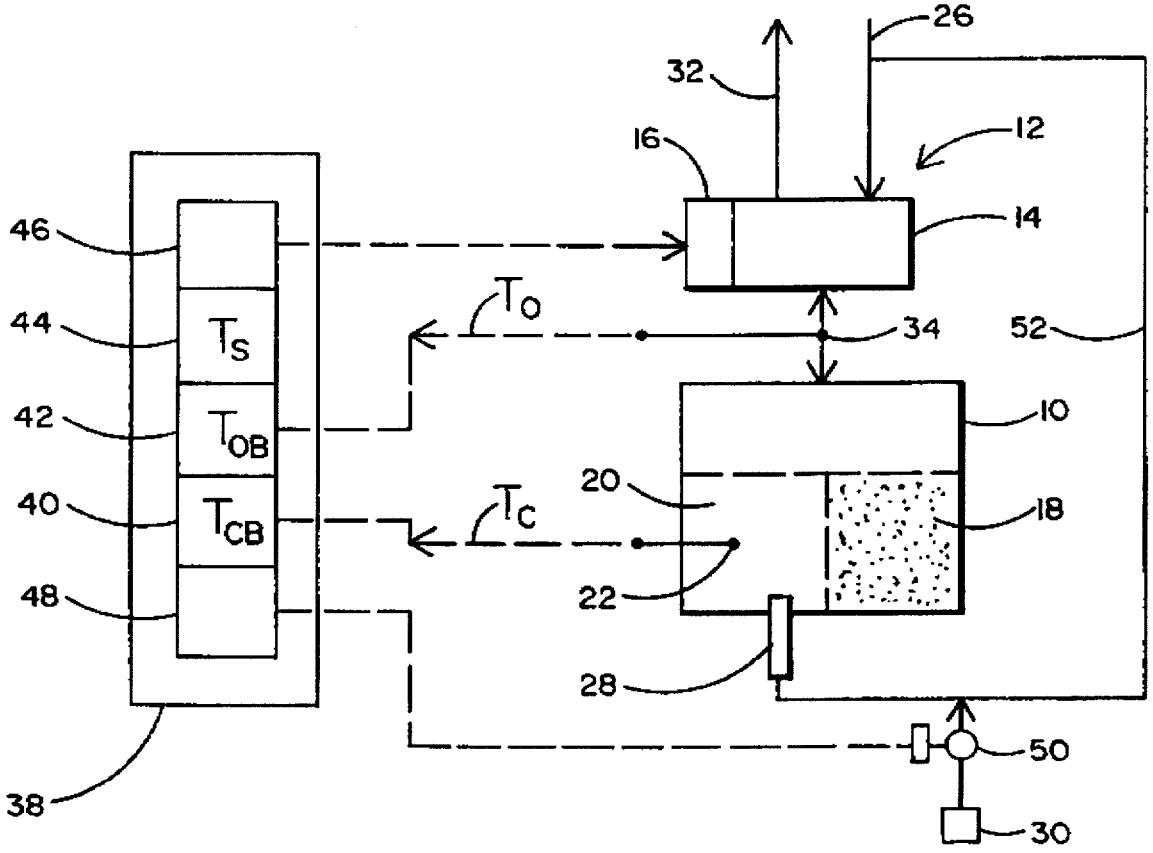
FIG. 2 is a schematic flow diagram of a control system for reversing the direction of flow of a gas stream through a regenerative incinerator system.

A regenerative incinerator system 10 closely coupled to a flow directing means 12 is schematically illustrated in FIG. 2. Means 12 comprises switching device 14 and actuator 16 therefor. System 10 comprises heat-accumulating and heat-exchanging means 18 and combustion zone 20. Temperature sensing means 22 enables continuous monitoring of the combustion zone temperature $T_C$.

A process exhaust stream containing combustible contaminants enters flow directing means 12 through line 26 and is directed to, and is heated in heat-accumulating and heat-exchanging means 18. The gas stream from means 18 then enters combustion zone 20 where it undergoes combustion. If the temperature in combustion zone 20 is below a predetermined temperature, heat is added by burner 28 which is supplied with fuel from source 30. The combustible contaminants in the gas stream are incinerated in combustion zone 20 and exhausted from regenerative incinerator system 10 into flow directing means 12 and from there to the atmosphere through line 32. The temperature, $T_O$, of the gas stream from the regenerative incinerator system is measured by temperature sensing means 34.

Control means 38 comprises means 40 for establishing a combustion zone base temperature set-point, or $T_{CB}$, means 42 for establishing an outlet base temperature set-point, or $T_{OB}$, data processor means 44 and switching signal generator means 46.

In operation the temperature $T_C$ in combustion zone 20 and the outlet temperature $T_O$ of the gas stream from the regenerative incinerator system are feed to control means 38. Data processor means 44 produces a switching temperature, or $T_S$, from input data $T_C$, $T_{CB}$ and $T_{OB}$. When the gas stream temperature $T_O$ from the regenerative incinerator system reaches $T_S$, switching signal generator means 46 actuates actuator 16 of flow directing means 12 and causes actuator 16 to reverse the direction of flow through the switching device 14 and as a consequence thereof reverses the gas stream flow through regenerative incinerator system 10.

In this invention, the combustion zone base temperature set-point $T_{CB}$ and the outlet base temperature set-point $T_{OB}$ are selected and established in control means. Selection of $T_{CB}$ and $T_{OB}$ can be, and preferably is based on the average condition of the process exhaust stream as usually received from the particular pollutant source for incineration. Whenever the combustion zone temperature drops below $T_{CB}$, supplementary fuel is burned in a controlled manner with burner 28.

In one embodiment, if the actual combustion zone temperature $T_C$ is less than 50° F. below or above set-point $T_{CB}$, then control means 38 adjusts the switching temperature $T_S$ to a temperature equal to $T_{OB}$. If the actual combustion zone temperature $T_C$ is more than 50° F. below set-point $T_{CB}$, control means 38 adjusts the switching temperature $T_S$ to a temperature lower than $T_{OB}$ by a predetermined amount. This causes the flow directing means to change the flow direction of the gas stream through the regenerative incinerator system sooner than otherwise would occur and, as a consequence of this invention, the supplementary fuel requirement is reduced. If the actual combustion zone temperature $T_C$ is equal to or more than 50° F. above set-point $T_{CB}$, control means 38 adjusts the switching temperature $T_S$ to a temperature higher than $T_{OB}$ by a predetermined amount which increases as the temperature difference ($T_C-T_{CB}$) increases. In one embodiment, the predetermined amount increases linearly with the temperature difference ($T_C-T_{CB}$). In a further embodiment, the predetermined amount increases linearly with the temperature difference by an amount equal to one-half of the temperature difference ($T_C-T_{CB}$). Therefore, in such embodiment, $T_S=T_{OB}+0.5$.

($T_C$–$T_{CB}$). Thus the switching temperature $T_S$ is raised rather than introducing ambient air into the regenerative incinerator system to cool the system. By raising $T_S$ more heat is exhausted to the atmosphere when the VOC load is high. This method therefore controls high VOC spikes or temporary increases in VOC loading without resorting to purge or supplementary cooling air. By raising $T_S$ and not cooling with ambient air, less fan power is required which improves process efficiency.

In a still further embodiment, if $T_C$ is more than 100° F. below $T_{CB}$, the control means 38 lowers the switching temperature $T_S$ by another predetermined amount and still more supplementary fuel is save. Adjustments to $T_S$ for combustion zone temperature drops below $T_{CB}$ other than for 50° and 100° F. increments can be used if desired.

In general, when the actual combustion zone temperature or $T_C$ exceeds the combustion zone base temperature set-point or $T_{CB}$, fuel control module 48 of control means 38 signals flow regulating means 50 to stop supplying supplementary fuel to burner 28. This burner-added supplementary fuel is sometimes refer to as "burner supplementary fuel". For $T_C$ below $T_{CB}$, module 48 signals flow regulating means 50 to adjust the flow of supplementary fuel in a predetermined manner. In one embodiment, module 48 signals comprises a proportional-integral-derivative controller.

In an alternative embodiment supplementary fuel is added directly to line 26 as shown by line 52 and is mixed with the feed process exhaust stream. This is sometimes referred to as "non-burner supplementary fuel", meaning that burner 28 is not required.

Figure 3:
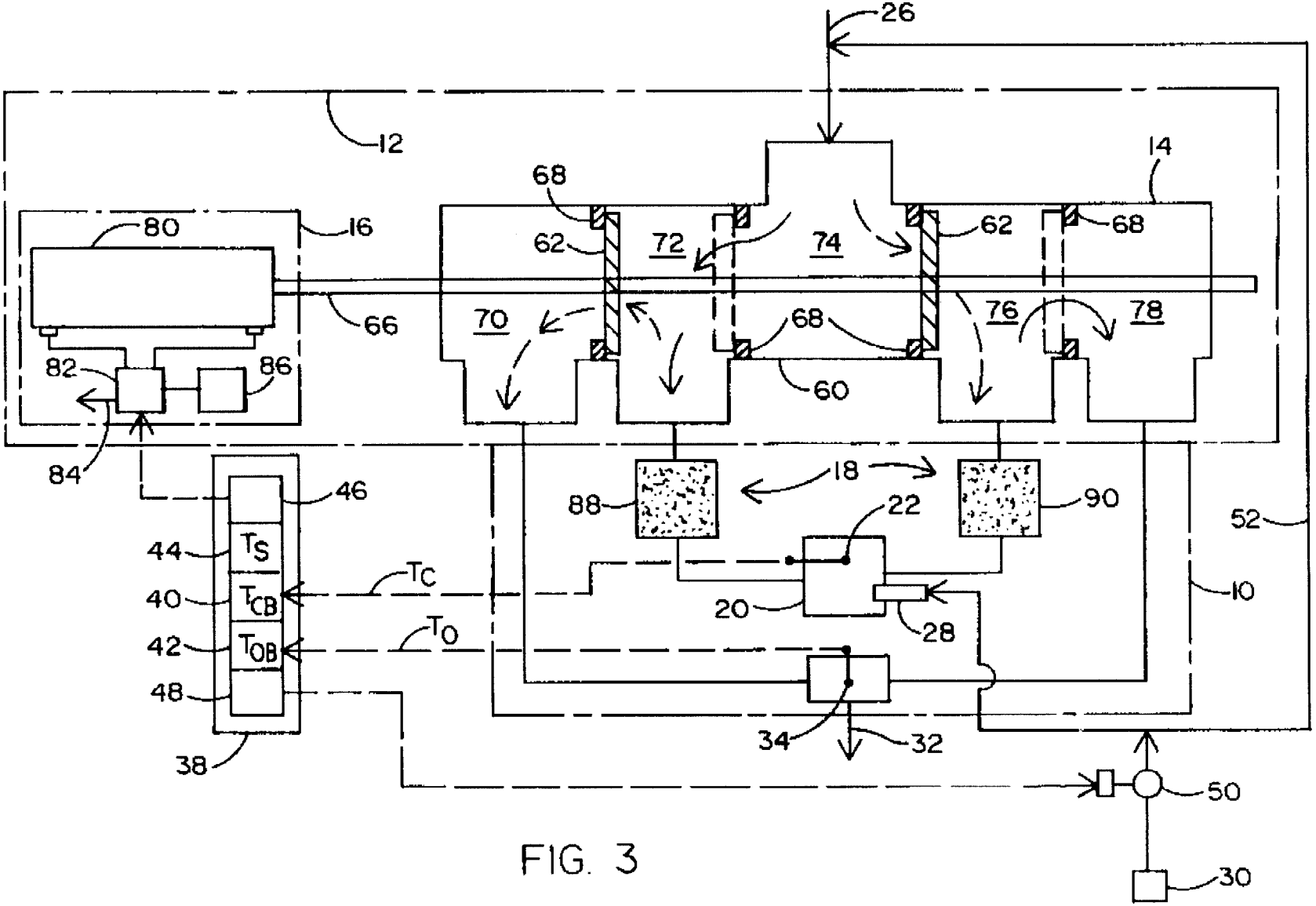
FIG. 3 is a schematic flow diagram of another control system for reversing the direction of flow of a gas stream through a regenerative incinerator system having two beds.

Another regenerative incinerator system 10 closely coupled to a flow directing means 12 is schematically illustrated in FIG. 3. Means 12 comprises switching device 14 and actuator 16 therefor. Switching device 14 comprises housing 60, paddles 62 on shaft 66 and close-off means 68. Housing 60 contains five chamber 70, 72, 74, 76 and 78. Actuator 16 comprises pneumatic actuator 80 for driving shaft 66, air directing means 82 with air vent 84, and compressed air source 86.

System 10 comprises heat-accumulating and heat-exchanging means 18, combustion zone 20 and temperature sensing means 22 for continuous monitoring of the combustion zone temperature TC. Means 18 comprises two heat accumulating and heat exchanging beds 88 and 90 connected to chambers 72 and 76, respectively. Chambers 70 and 78 are connected to vent line 32. Chamber 74 is connected to inlet line 26.

When in use, a process exhaust stream containing combustible contaminants enters through line 26 to chamber 74 of flow directing means 12 and from there is directed to, and is heated in one of beds 88 and 90 of heat-accumulating and heat-exchanging means 18. With paddles 62 in the position shown with solid cross-hatched lines, the gas stream flows from chamber 74, to chamber 72, to bed 88, to combustion zone 20, to bed 90, to chamber 76, to chamber 78, to vent line 32 and then to the atmosphere as shown by the solid flow arrows. With paddles 62 in the position shown with dashed lines, the gas stream flows from chamber 74, to chamber 76, to bed 90, to combustion zone 20, to bed 88, to chamber 72, to chamber 70, to vent line 32 and then to the atmosphere as shown by the dashed flow arrows.

The gas stream heated in bed 88 undergoes combustion in combustion zone 20 and the hot combustion gas then heats bed 90. When outlet temperature sensing means 34 indicates that the temperature has reached switching temperature $T_S$ module 46 causes air directing means 82 to trigger pneumatic actuator 80 to drive shaft 66 and paddles 62 to their opposite position, as shown by the dashed lines, thereby reversing the direction of flow of the gas stream through beds 88 and 90.

Figure 4:
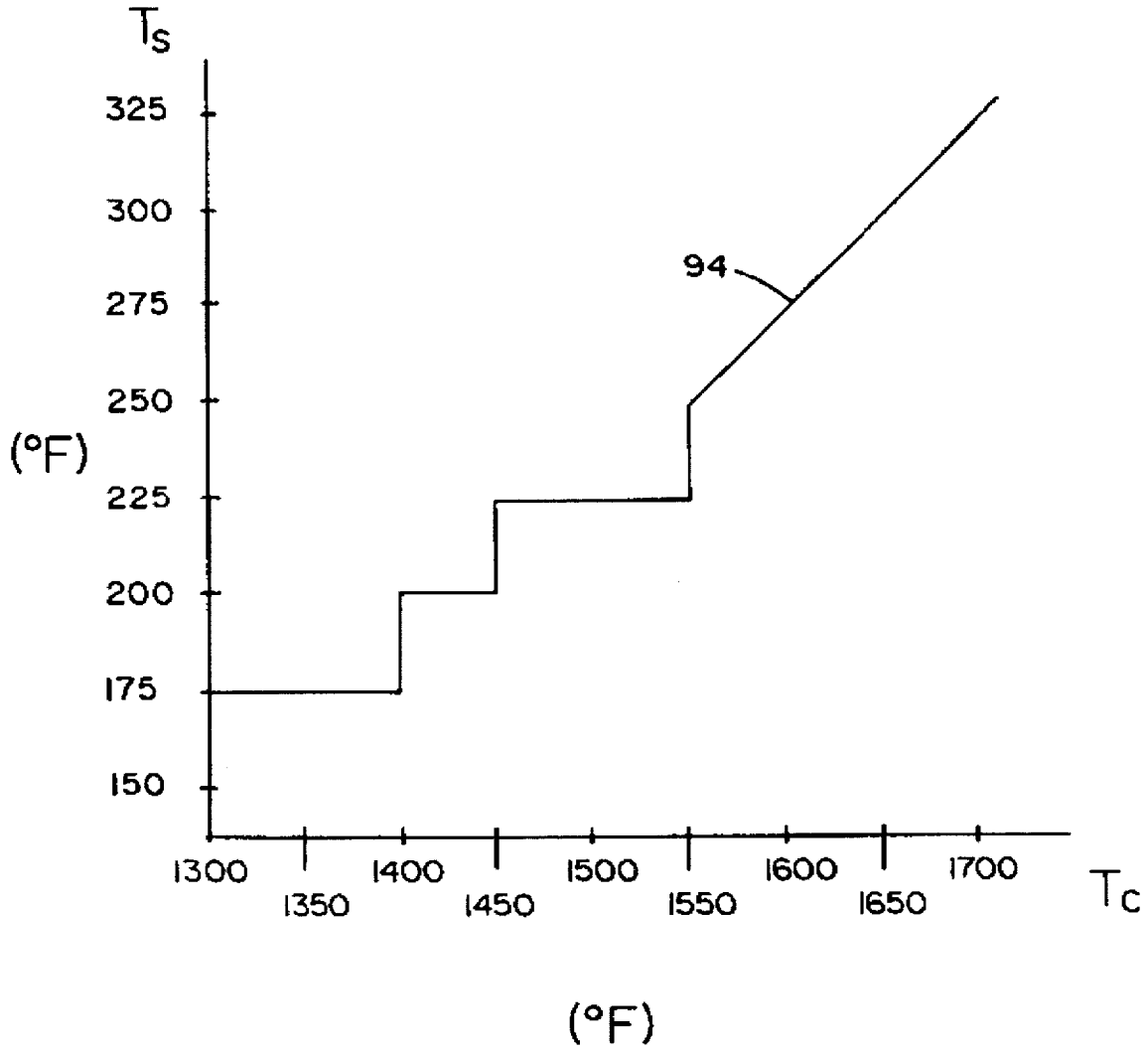
FIG. 4 is another graphic illustration of the switching temperature, or $T_S$, as function of $T_O$.

In one embodiment, the nominal or base combustion zone set-point temperature, or $T_{CB}$, is established at 1500° F. and the nominal or outlet base set-point temperature, or $T_{OB}$, at 225° F. In this embodiment the switching temperature, or $T_S$, is varied as shown by curve 94 in FIG. 4. Thus for actual combustion zone temperatures, of $T_C$'s more than 1450° and less than 1550° F., $T_S$ is equal to $T_{OB}$ or 225° F. For $T_C$'s more than 1400° to 1450° F., $T_S$ is equal to 200° F. For $T_C$'s equal to and less than 1400° F., $T_S$ is equal to 175° F. For $T_C$'s equal to and more than 1550° F., $T_S$ is equal to {225° F.+(0.5. {$T_C$° F.–$T_{CB}$° F.})}.

In a further embodiment, the adjusting of $T_S$ is accomplished using a control means. In a still further embodiment, the control means readjusts the value of $T_S$ on a predetermined time cycle having a duration per cycle greater than about 0.001 second but no greater than about 10 seconds.

Although it is preferred to have an electronic control means control the adjusting of the switching temperature $T_S$, the reversing of the flow directing means, and the introduction of supplementary fuel into the system, such controls can be performed by manual control.

While the preferred embodiments of the present invention 18 have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. A method for incinerating gas streams containing VOC comprising:

(a) providing an incinerator means for incinerating a gas stream, the incinerator means having at least one gas permeable bed of solid material having heat-accumulating and heat-exchanging capability, and a combustion zone for combustion of the gas stream;

(b) providing a flow directing means for directing the gas stream to and from the incinerator means and for reversing the flow direction of the gas stream to and from the incinerator means;

(c) introducing a gas stream containing VOC into the flow directing means;

(d) receiving the gas stream from the flow directing means and conveying it to a vent duct means;

(e) discharging the gas stream from the vent duct means to an environment;

(f) sensing a combustion zone temperature, or $T_C$, in the combustion zone;

(g) establishing a combustion zone base temperature or $T_{CB}$;

(h) providing and controlling supplemental heating of the incinerator means so that such heating increases with increasing values of the temperature difference ($T_{CB}-T_C$), and is shut off when $T_C \geqq T_{CB}$;

(i) sensing an outlet temperature, or $T_O$, in the vent duct means;

(j) establishing an outlet base temperature, or $T_{OB}$;

(k) adjusting a switching temperature, or $T_S$, to $T_{OB}$, when ($T_{CB}-T_C$) is less than a first predetermined value and when ($T_C-T_{CB}$) is less than a second predetermined value, downwards a first predetermined amount below $T_{OB}$, when ($T_{CB}-T_C$) is equal to or more than the first predetermined value, upwards a second predetermined amount above $T_{OB}$, when ($T_C-T_{CB}$) is equal to or more than the second predetermined value; and (l) causing the flow directing means to reverse the flow direction of the gas stream to and from the incinerator means when $T_O$ reaches $T_S$.

2. The method of claim 1, wherein the second predetermined value is about equal to the first predetermined value.

3. The method of claim 1, wherein the first predetermined amount consists of a first degree span and a second degree span, and wherein the adjusting of $T_S$ downward in the second degree span is greater than the adjusting of $T_S$ downward in the first degree span.

4. The method of claim 1, wherein the first degree span is a constant amount, and wherein the second degree span is a constant amount.

5. The method of claim 1, wherein the second predetermined amount is a function of the temperature difference ($T_C-T_{CB}$), and wherein the second predetermined amount increases as ($T_C-T_{CB}$) increases.

6. The method of claim 1, wherein the first predetermined value is from about 25° F. to about 75° F., wherein the first predetermined amount consists of a first degree span and a second degree span, wherein the first degree span is from about 10° to about 50° F., and wherein the second degree span is from about 20° to about 100° F., and wherein the second predetermined value is from about 25° F. to about 75° F., wherein the second predetermined amount is a fraction of the temperature difference ($T_C-T_{CB}$).

7. The method of claim 1, wherein the first predetermined value is about 50° F., wherein the second predetermined value is about 50° F., wherein the first predetermined amount consists of a first degree span and a second degree span, wherein the first degree span is about 25° F., and wherein the second degree span is about 50° F., and wherein the second predetermined amount is one half of the temperature difference ($T_C-T_{CB}$).

8. A method for incinerating gas streams containing VOC comprising:

(a) providing an incinerator means for incinerating a gas stream, the incinerator means having at least one gas permeable bed of solid material having heat-accumulating and heat-exchanging capability, and a combustion zone in fluid communication with said at least one gas permeable bed for combustion of the gas stream;

(b) providing a flow directing means operatively connected to the incinerator means for directing the gas stream to and from the incinerator means and for reversing the flow direction of the gas stream to and from the incinerator means;

(c) introducing a gas stream containing VOC into the flow directing means;

(d) providing vent duct means for receiving the gas stream from the flow directing means and for discharging the gas stream to an environment;

(e) providing supplemental heating means for heating the incinerator means, the supplemental heating means operable for providing an adjustable heat delivering rate to the incinerator means;

(f) providing combustion zone temperature sensing means for sensing a combustion zone temperature or $T_C$, where $T_C$ is the actual temperature of the gas stream in the combustion zone;

(g) providing heating control means operatively connected to the combustion zone temperature sensing means and the supplemental heating means, the heating control means having a combustion zone base temperature set-point or $T_{CB}$, the heating control means for controlling the supplemental heating means so its heat delivering rate increases with increasing values of the temperature difference ($T_{CB}-T_C$), and for shutting off the supplemental heating means when $T_C \geqq T_{CB}$;

(h) providing outlet temperature sensing means for sensing an outlet temperature or $T_O$, where $T_O$ is the actual temperature of the gas stream in the vent duct means;

(i) establishing an outlet base temperature set-point or $T_{OB}$;

(j) adjusting a switching temperature or $T_S$ to satisfy the relationship $T_S=T_{OB}$, when $(T_{CB}-Y_1)<T_C<(T_{CB}+Y_1)$, $T_S=T_{OB}-X_1$, when $Y_1<(T_{CB}-T_C)<Y_2$, where $Y_1$ is a first predetermined positive temperature difference, where $Y_2$ is a second predetermined positive temperature difference, where $X_1=F_1 \cdot Y_1$, where $F_1$ is a predetermined positive function greater than zero and less than one, $T_S=T_{OB}-X_2$, when $(T_{CB}-T_C) \geqq Y_2$, where $X_2=F_2 \cdot Y_2$, where $F_2$ is a predetermined positive function greater than zero and less than one, where $X_2>X_1$, and $T_S=T_{OB}+X_3$, when $(T_C-T_{CB}) \geqq Y_1$, where $X_3=F_3 \cdot (T_C \cdot T_{CB})$ where $F_3$ is a predetermined positive function greater than zero and less than one; and (k) causing the flow directing means to reverse the flow direction of the gas stream to and from the incinerator means when $T_O$ reaches $T_S$.

9. The method of claim 8, wherein $F_1$, $F_2$ and $F_3$ are constants, and $Y_2/Y_1$ is about 2.

10. The method of claim 8, wherein $X_2$ about equal to $X_1$, $X_3$ about equal to $X_1$, and $Y_2/Y_1$ is about 2.

11. The method of claim 8, wherein $F_1$ is from about 0.25 to about 0.75, $F_2$ is from about 0.25 to about 0.75, $F_3$ is from about 0.25 to about 0.75, $Y_1$ is from about 25° to about 75° F., and $Y_2$ is from about 50° to about 150° F.

12. The method of claim 8, wherein $F_1$ is from about 0.4 to about 0.6, $F_2$ is from about 0.4 to about 0.6, $F_3$ is from about 0.4 to about 0.6, $Y_1$ is from about 40° to about 60° F., and $Y_2$ is from about 80° to about 120° F.

13. The method of claim 8, wherein $F_1$ is about 0.5, $F_2$ is about 0.5, $F_3$ is about 0.5, $Y_1$ is about 50° F., and $Y_2$ is about 100° F.

14. The method of claim 8, wherein $T_{CB}$ is from about 1400° to about 1600° F., and $T_{OB}$ is from about 200° to about 300° F.

15. The method of claim 8, wherein $T_{CB}$ is about 1500° F., and $T_{OB}$ is about 225° F.

16. The method of claim 8, wherein the incinerator means has at least two gas permeable beds of solid material having heat-accumulating and heat-exchanging capability, and the combustion zone in fluid communication with each of said at least two gas permeable beds.

17. The method of claim 8, wherein the incinerator means has two gas permeable beds of solid material having heat-accumulating and heat-exchanging capability, and the combustion zone is spaced between the two beds and in fluid communication with each of the beds.

18. The method of claim 8, wherein the heating control means comprises a proportional-integral-derivative controller.

19. A system for incinerating gas streams containing VOC comprising:

(a) incinerator means for incinerating a gas stream, the incinerator means having two gas permeable beds of solid material having heat-accumulating and heat-exchanging capability, and also having a combustion zone spaced between the two gas permeable beds for combustion of the gas stream and for flowing the gas stream from one of the beds to the other bed;

(b) flow directing means operatively connected to the incinerator means for directing the gas stream to and from the incinerator means and for reversing the flow direction of the gas stream to and from the incinerator means;

(c) inlet means for receiving a gas stream containing VOC and introducing it into the flow directing means;

(d) vent duct means for receiving the gas stream from the flow directing means and for discharging the gas stream to an environment;

(e) supplemental heating means for heating the incinerator means, the supplemental heating means operable for providing an adjustable heat delivering rate to the incinerator means;

(f) combustion zone temperature sensing means for sensing a combustion zone temperature or $T_C$, where $T_C$ is the actual temperature of the gas stream in the combustion zone;

(g) heating control means operatively connected to the combustion zone temperature sensing means and the supplemental heating means, the heating control means having a combustion zone base temperature set-point or $T_{CB}$, the heating control means for controlling the supplemental heating means so its heat delivering rate increases with increasing values of a temperature difference $(T_{CB}-T_C)$, and for shutting off the supplemental heating means when $T_C \geqq T_{CB}$; and (h) outlet temperature sensing means for sensing an outlet temperature or $T_O$, where $T_O$ is the actual temperature of the gas stream in the vent duct means;

(i) flow directing control means operatively connected to the combustion zone temperature sensing means, to the outlet temperature sensing means, and to the flow directing means and having an outlet base temperature set-point or $T_{OB}$, the flow directing control means for causing the flow directing means to reverse the flow direction of the gas stream to and from the incinerator means when $T_O$ reaches a switching temperature or $T_S$, the flow directing control means for adjusting $T_S$ to satisfy the relationship $T_S=T_{OB}$, when $(T_{CB}-Y_1)<T_C<(T_{CB}+Y_1)$, $T_S=T_{OB}-X_1$, when $Y_1 \geqq (T_{CB}-T_C)<Y_2$, where $Y_1$ is a first predetermined positive temperature difference, where $Y_2$ is a second predetermined positive temperature difference, where $X_1=F_1 \cdot Y_1$, where $F_1$ is a predetermined positive function greater than zero and less than one, thereby conserving energy, $T_S=T_{OB}-X_2$, when $(T_{CB}-T_C) \geqq Y_2$, where $X_2=F_2 \cdot Y_2$, where $F_2$ is a predetermined positive function greater than zero and less than one, where $X_2>X_1$, thereby conserving energy, and $T_S=T_{OB}+X_3$, when $(T_C-T_{CB}) \geqq Y_1$, where $X_3=F_3 \cdot (T_C-T_{CB})$ where $F_3$ is a predetermined positive function greater than zero and less than one, thereby rejecting more heat to the environment.

20. The system of claim 19, wherein $F_1$ is from about 0.4 to about 0.6, $F_2$ is from about 0.4 to about 0.6, $F_3$ is from about 0.4 to about 0.6, $Y_1$ is from about 40° to about 60° F., $Y_2$ is from about 80° to about 120° F., $T_{CB}$ is from about 1400° to about 1600° F., and $T_{OB}$ is from about 200° to about 300° F.

21. A method for controlling a flow directing means used for directing a gas stream to and from a regenerative incinerator system and for reversing the flow direction of the gas stream through the flow directing means, the regenerative incinerator system having a combustion zone and a heat accumulating and heat exchanging zone, the method comprising:

(a) adjusting a switching temperature, or $T_S$, (i) to an outlet base temperature, or $T_{OB}$, when the temperature in the combustion zone is more than a first predetermined temperature and less than a second predetermined temperature, (ii) downwards a first predetermined amount below $T_{OB}$, when the temperature in the combustion zone is equal to or less than the first predetermined temperature, (iii) upwards a second predetermined amount above $T_{OB}$, when the temperature in the combustion zone, or $T_C$, is equal to or greater than the second predetermined temperature; and (b) causing the flow directing means to reverse the flow direction of the gas stream through the regenerative incinerator system when the gas stream temperature from the regenerative incinerator system, or $T_O$, reaches $T_S$.

22. The method of claim 21, further comprising readjusting the value of $T_S$ on a predetermined time cycle having a duration per cycle no greater than about 10 seconds.

23. A method for controlling a flow directing means used for directing a gas stream to and from a regenerative incinerator system and for reversing the flow direction of the gas stream through the regenerative incinerator system, the regenerative incinerator system having a combustion zone and a heat accumulating and heat exchanging zone, the method comprising:

(a) establishing a combustion zone base temperature set-point, or $T_{CB}$ for referencing combustion zone temperatures;

(b) establishing an outlet base temperature set-point, or $T_{OB}$, for referencing outlet temperatures, from the regenerative incinerator system;

(c) establishing a switching temperature, or $T_S$, as a function of $T_C$, $T_{CB}$ and $T_{OB}$, wherein the slope of said function, or $dT_S/dT_C$, is never negative over a predetermined range of combustion zone temperatures, and wherein the switching temperature is equal to $T_{OB}$ when the combustion zone temperature is equal to $T_{CB}$; and (d) causing the flow directing means to reverse the flow direction of the gas stream through the regenerative incinerator system when the gas stream temperature from the regenerative incinerator system, or $T_O$, reaches $T_S$.

24. The method of claim 23, wherein the slope of said function is zero when the combustion zone temperature is equal to $T_{CB}$.

* * * * *